US008590574B2

(12) United States Patent
Jian et al.

(10) Patent No.: US 8,590,574 B2
(45) Date of Patent: Nov. 26, 2013

(54) GAS STOP STRUCTURE CAPABLE OF REPEATED INFLATION AND DEFLATION

(75) Inventors: Bo-Xin Jian, New Taipei (TW); Chieh-Hua Liao, New Taipei (TW); Yaw-Shin Liao, New Taipei (TW)

(73) Assignees: Air-Bag Packing Co., Ltd., New Taipei (TW); Yaw-Shin Liao, New Taipei (TW)

( * ) Notice: Subject to any disclaimer, the term of this patent is extended or adjusted under 35 U.S.C. 154(b) by 173 days.

(21) Appl. No.: 13/243,799

(22) Filed: Sep. 23, 2011

(65) Prior Publication Data

US 2012/0312388 A1 Dec. 13, 2012

(30) Foreign Application Priority Data

Jun. 8, 2011 (TW) ..... 100120003 A

(51) Int. Cl.
*F16K 15/14* (2006.01)

(52) U.S. Cl.
USPC ..... 137/846; 137/223; 383/3; 383/43; 383/44; 206/522

(58) Field of Classification Search
USPC ..... 137/223, 843, 844, 846–848, 850; 5/655.3; 446/220, 221, 224; 383/3, 43, 383/44, 48, 57, 94; 206/522
See application file for complete search history.

(56) References Cited

U.S. PATENT DOCUMENTS 2,799,314 A * 7/1957 Dreyer et al. ..... 383/44
3,113,551 A * 12/1963 Korn ..... 446/220
3,282,412 A * 11/1966 Corella et al. ..... 383/44
3,313,472 A * 4/1967 Tjerneld et al. ..... 383/44
3,565,078 A * 2/1971 Vailliancourt et al. ..... 137/223
3,887,213 A * 6/1975 Goetz ..... 137/843
4,674,532 A * 6/1987 Koyanagi ..... 137/849
5,144,708 A * 9/1992 Pekar ..... 137/223
5,183,432 A * 2/1993 Noguchi ..... 446/220
5,372,487 A * 12/1994 Pekar ..... 137/846
5,558,441 A * 9/1996 Morrison et al. ..... 383/44
5,595,521 A * 1/1997 Becker ..... 446/224
5,830,780 A * 11/1998 Dennison et al. ..... 137/843
5,860,441 A * 1/1999 Garcia ..... 137/223
5,934,310 A * 8/1999 Littlehorn ..... 137/223
6,015,601 A * 1/2000 Garcia ..... 137/223
6,042,448 A * 3/2000 Littlehorn ..... 137/223
6,170,513 B1 * 1/2001 Lo ..... 137/223
6,247,488 B1 * 6/2001 Peterson ..... 137/223
6,446,658 B1 * 9/2002 O'Brien ..... 137/223

(Continued)

*Primary Examiner* — Craig Schneider
*Assistant Examiner* — Craig J Price
(74) *Attorney, Agent, or Firm* — Muncy, Geissler, Olds & Lowe, PLLC

(57) ABSTRACT

A gas stop structure capable of repeated inflation and deflation is provided, which includes: a plurality of outer films; a gas chamber area, formed of the plurality of outer films and including a buffer portion and a gas storage portion; a gas stop valve, located between the plurality of outer films, in which a part of the gas stop valve is exposed beyond the plurality of outer films; and a warp portion, connected the buffer portion and the gas storage portion. When a gas tube is placed inside the gas stop valve to inflate the gas chamber area with gas, a height of the inflated gas storage portion is greater than that of the buffer portion to form a sectional difference, so the gas storage portion bends towards the buffer portion to seal the warp portion. After inflation, the gas tube is removed and the gas stop valve is sealed.

10 Claims, 14 Drawing Sheets

(56) References Cited

U.S. PATENT DOCUMENTS

| | | | | |
|---|---|---|---|---|
| 6,886,202 | B2 * | 5/2005 | Frechette | 5/655.3 |
| 6,934,989 | B2 * | 8/2005 | Ledvina et al. | 137/846 |
| 7,249,612 | B2 * | 7/2007 | Koyanagi | 137/846 |
| 7,926,507 | B2 * | 4/2011 | Wetsch et al. | 137/223 |
| 7,959,003 | B2 * | 6/2011 | Liao et al. | 206/522 |
| 7,959,759 | B2 * | 6/2011 | Liao et al. | 156/308.4 |
| 7,992,601 | B2 * | 8/2011 | Liao et al. | 137/223 |
| 8,210,352 | B2 * | 7/2012 | Liao et al. | 206/522 |
| 8,360,641 | B2 * | 1/2013 | Kim | 206/522 |
| 2002/0166788 | A1 * | 11/2002 | Sperry et al. | 206/522 |
| 2010/0096290 | A1 * | 4/2010 | Frayne et al. | 206/522 |
| 2010/0101970 | A1 * | 4/2010 | Frayne et al. | 206/522 |
| 2011/0233101 | A1 * | 9/2011 | Baines | 206/522 |

* cited by examiner

GAS STOP STRUCTURE CAPABLE OF REPEATED INFLATION AND DEFLATION

CROSS-REFERENCES TO RELATED APPLICATIONS

This non-provisional application claims priority under 35 U.S.C. §119(a) on Patent Application No. 100120003 filed in Taiwan, R.O.C. on 2011 Jun. 08, the entire contents of which are hereby incorporated by reference.

BACKGROUND OF THE INVENTION

1. Technical Field

The present invention relates to a gas packing bag structure, and more particularly to a gas stop structure capable of repeated inflation and deflation.

2. Related Art

A gas stop valve is disposed in a gas packing bag formed of enclosed plastic films through heat-seal bonding. The gas packing bag may be inflated with gas from outside through the gas stop valve. Furthermore, the gas stop valve stops air backflow to prevent the gas inside the packing bag from leaking. The gas stop valve is generally formed of two films partially adhered to each other with a gas passage being formed between the two films by means of heat-seal bonding, so that the packing bag may be inflated with gas through the gas passage. As the packing bag is filled with more and more gas, the pressure inside the packing bag gradually increases. Consequently, when the inflation stops, the two films of the gas stop valve are adhered under the gas pressure, thereby preventing the gas inside the packing bag from escaping.

During deflation of the gas packing bag using a gas stop valve structure, generally, a gas tube must be inserted into the packing bag through the gas passage of the gas stop valve for discharge. However, in practical applications, as the two films of the gas stop valve are adhered under the gas pressure inside the packing bag, it is very difficult to insert the gas tube into the packing bag through the gas passage of the gas stop valve for discharge. In some cases, the gas tube might even damage the gas stop valve (for example, the gas tube pierces through the gas stop valve to damage the films thereof), and cause gas leakage from the packing bag. Furthermore, the gas stop valve is formed of two films. When the gas passage is formed through heat-seal bonding of the two films, the gas passage has a texture preventing the gas tube from being placed in the gas passage. As a result, deflation becomes impossible and the packing bag cannot be inflated and used again, causing inconvenience to users of such a gas packing bag.

SUMMARY

Accordingly, the present invention provides a gas stop structure capable of repeated inflation and deflation, which includes: a plurality of outer films; a gas chamber area, formed through heat-seal bonding of the plurality of outer films and including a buffer portion and a gas storage portion, in which an area of the buffer portion is smaller than an area of the gas storage portion; a gas stop valve, located between the plurality of outer films through heat-seal bonding, in which a part of the gas stop valve is located in the buffer portion, and another part is exposed beyond the plurality of outer films; and a warp portion, formed through heat-seal bonding of the plurality of outer films and located between the buffer portion and the gas storage portion, in which the warp portion includes a connecting hole through which the buffer portion and the gas storage portion are in communication.

When a gas tube is placed inside the gas stop valve to inflate the gas chamber area with gas, a height of the inflated gas storage portion is greater than that of the buffer portion, forming a sectional difference, so the gas storage portion bends towards the buffer portion with the warp portion as a central point to seal the connecting hole. As a result, the gas in the buffer portion presses the gas stop valve to close the gas stop valve, achieving a double gas closure effect.

The present invention also provides a gas stop structure capable of repeated inflation and deflation, which includes: a plurality of outer films; a gas stop valve located between the plurality of outer films through heat-seal bonding, in which the gas stop valve includes a plurality of first inner films, a plurality of second inner films and a buffer portion, a part of the plurality of first inner films is exposed beyond the plurality of outer films, a plurality of second inner films is located between the plurality of first inner films and is partially exposed beyond the plurality of first inner films, the buffer portion is located between the plurality of first inner films, and an area of the buffer portion is smaller than an area of a gas storage portion; and a warp portion, formed through heat-seal bonding of the plurality of outer films and located between the buffer portion and the gas storage portion, in which the warp portion includes a connecting hole through which the buffer portion and the gas storage portion are in communication. When the gas storage portion is inflated with gas through the gas stop valve, the gas inside the gas storage portion presses the gas stop valve to seal the connecting hole. The gas in the buffer portion consequently presses the plurality of second inner films, so that each film in the plurality of second inner films adheres to the other to achieve a double gas closure effect.

In the present invention, a small buffer portion and a large gas storage portion are formed in the gas chamber area by means of heat-seal bonding. During inflation, the gas first flows into the buffer portion through the gas stop valve and then flows into the gas storage area through the connecting hole to for inflation and expansion. As an area of the buffer portion is small, an internal pressure thereof after inflation is low. In addition, a gas inlet position where the gas stop valve is located is inside the buffer portion, so that a resistance for the gas tube to be inserted into the buffer portion through the gas passage of the gas stop valve is small. It is therefore convenient to insert the gas tube. In this manner, the gas storage portion is capable of repeated inflation and deflation, prolonging its service life and reducing user costs.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
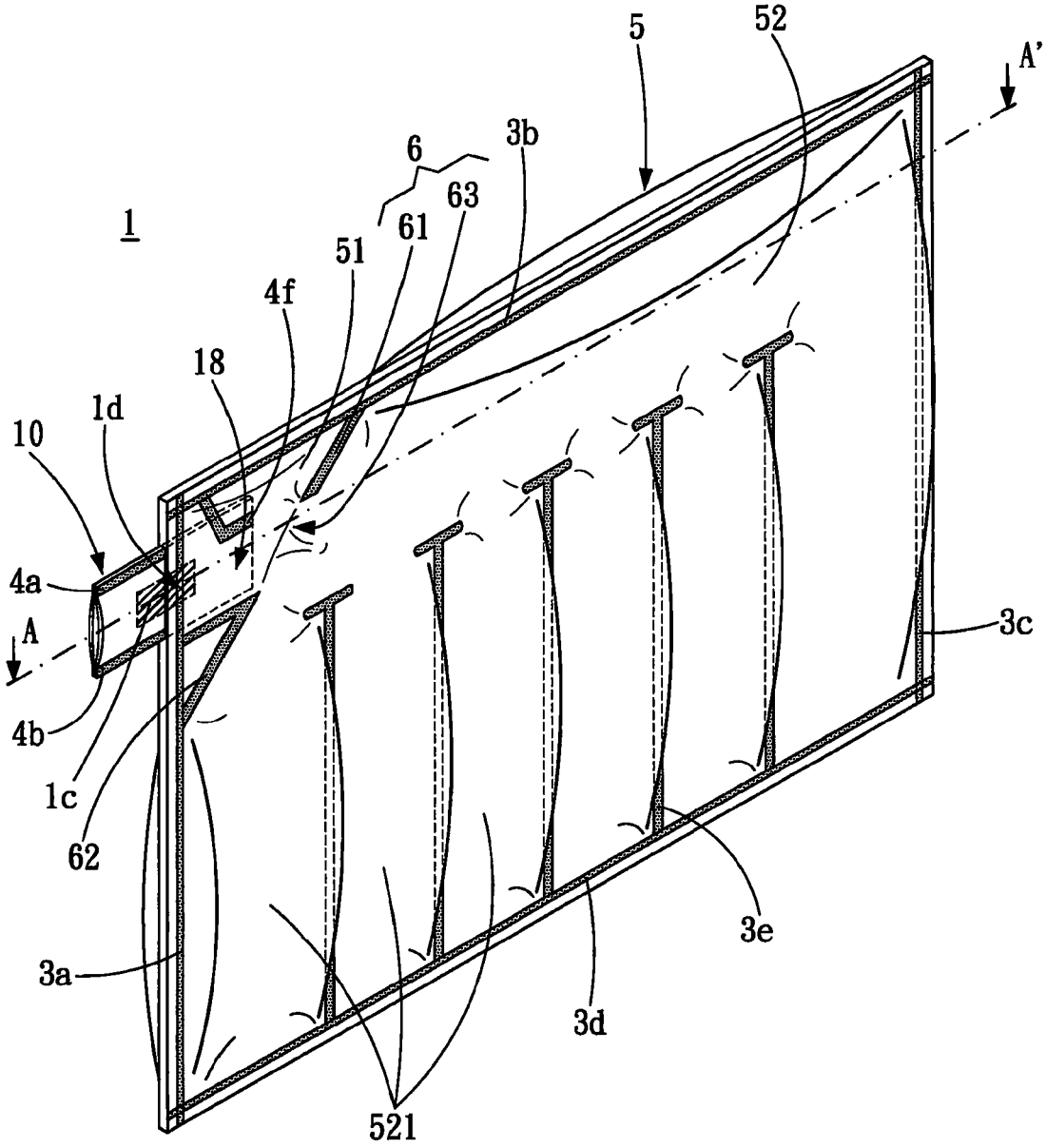
FIG. 1 is a schematic external view according to a first embodiment of the present invention.
Figure 2:
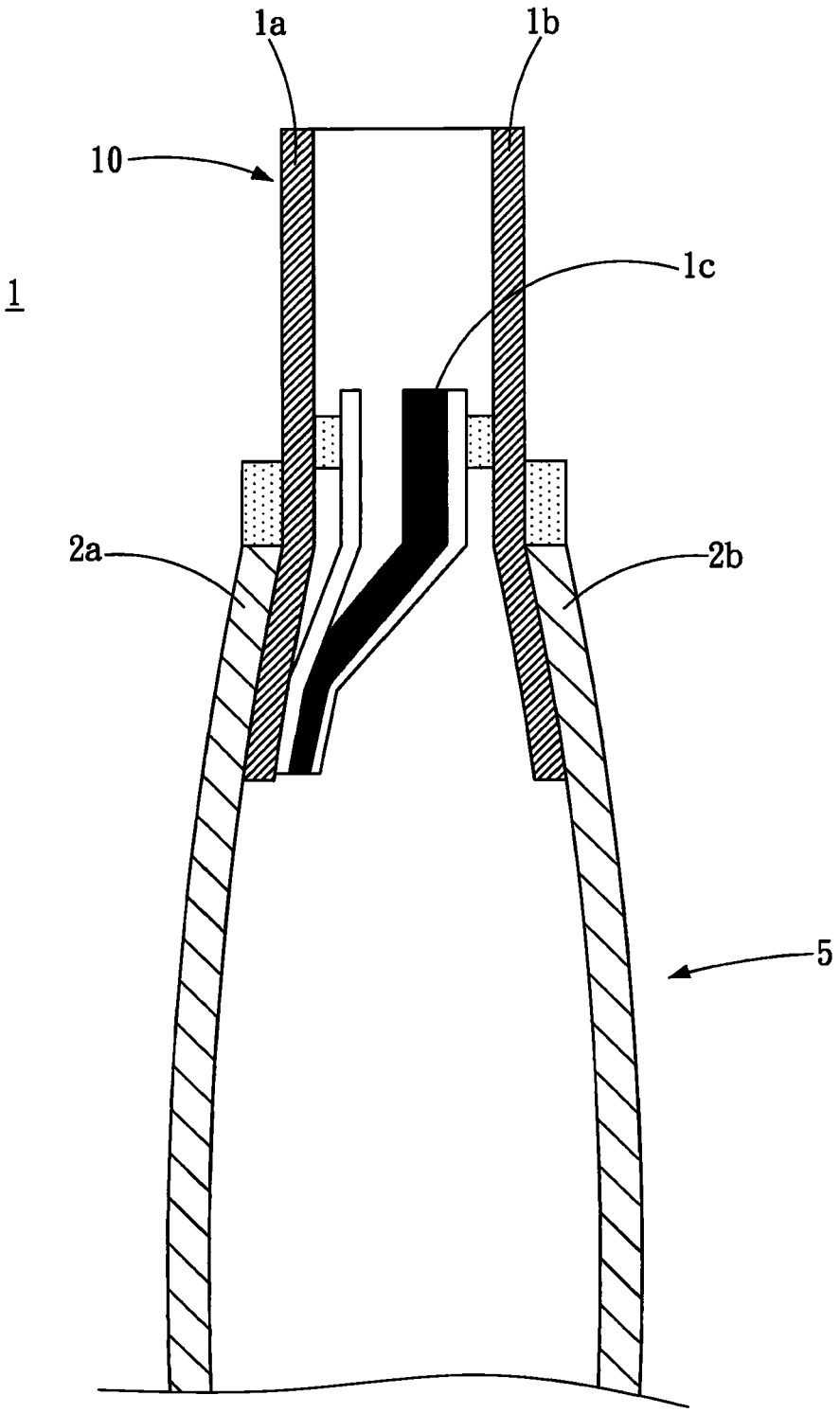
FIG. 2 is a schematic sectional view along a-a' in FIG. 1.

FIG. 1, FIG. 2, FIG. 3 and FIG. 4A show a gas stop structure capable of repeated inflation and deflation according to a first embodiment of the present invention.

A gas stop structure capable of repeated inflation and deflation 1 of the present invention includes two outer films 2*a* and 2*b*, two first inner films 11*a*, a gas stop valve 10, a gas chamber area 5 and a warp portion 6.

The two outer films 2*a* and 2*b* are stacked vertically, and may form bonding of heat seal lines 3*a*, 3*b*, 3*c* and 3*d* by means of heat sealing to form the gas chamber area 5. After the gas chamber area 5 is formed between the two outer films 2*a* and 2*b* by means of heat sealing, the warp portion 6 may be formed by means of heat sealing. A space between the two outer films 2*a* and 2*b* is divided into a buffer portion 51 and a gas storage portion 52, in which an area of the buffer portion 51 is smaller than an area of the gas storage portion 52. Furthermore, the gas storage portion 52 may be divided into a plurality of smaller gas columns 521 through a heat seal line 3*e*. It should be noted that a heat seal sequence herein is merely an example, and is not intended to limit the present invention.

Two first inner films 11*a* are stacked vertically, and may form bonding of heat seal lines 4*a* and 4*b* by means of heat sealing to form the gas stop valve 10. The gas stop valve 10 forms bonding of a heat seal line 4*f* by means of heat sealing to be located between the two outer films 2*a* and 2*b*. In addition, a part of the gas stop valve 10 is located between the two outer films 2*a* and 2*b*, that is, located inside the buffer portion 51, and another part is exposed beyond the two outer films 2*a* and 2*b*. Therefore, the inside and outside of the gas chamber area 5 are in communication through the gas stop valve 10. After the heat seal line 4*f* is formed by means of heat sealing, a guiding passage 18 may be formed at a side of the heat seal line 4*f* for guiding a gas tube 9 to be inserted into or move out from the gas stop valve 10. Furthermore, the gas stop valve 10 may adopt a four-layer film structure, which is equivalent to the gas stop valve 10 being formed of four films. That is, the gas stop valve 10 is formed of a plurality of second inner films 11*b* being stacked between a plurality of first inner films 11*a*, so that the gas stop valve 10 is tough and endurable, thereby prolonging a service life of the gas stop valve 10.

In addition, a heat-resistant material 1*c* is provided between the two first inner films 11*a*. When the heat seal line 3*a* connects the two first inner films 11*a* and the two outer films 2*a* and 2*b*, the two first inner films 11*a* are not bonded at the heat-resistant material 1*c* to form an opening 1*d* for the gas to flow. The heat-resistant material 1*c* may be preferably heat-resistant ink coated between the two first inner films 11*a*, or may be a heat-resistant blade placed at the two first inner films 11*a*. The heat-resistant blade is removed after the bonding of the heat seal line 3*a* is completed. However, the heat-resistant material 1*c* in the present invention is not limited to the heat-resistant ink or the heat-resistant blade. The above disposal of the heat-resistant material 1*c* is merely an example, and the heat-resistant material 1*c* may be disposed between the two first inner films 11*a* according to practical design requirements.

Figure 3:
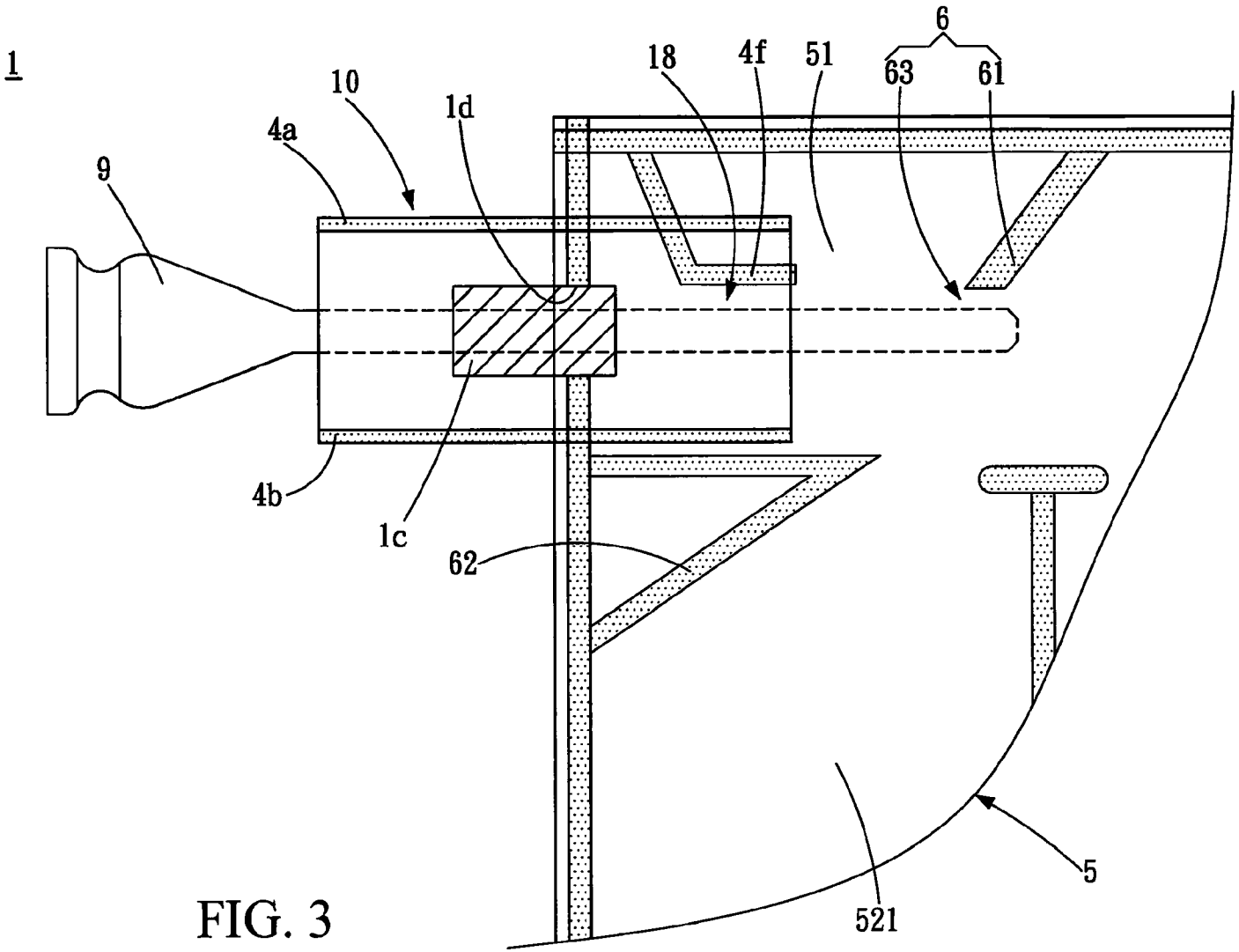
FIG. 3 is a first schematic front view according to the first embodiment of the present invention.
Figure 5:
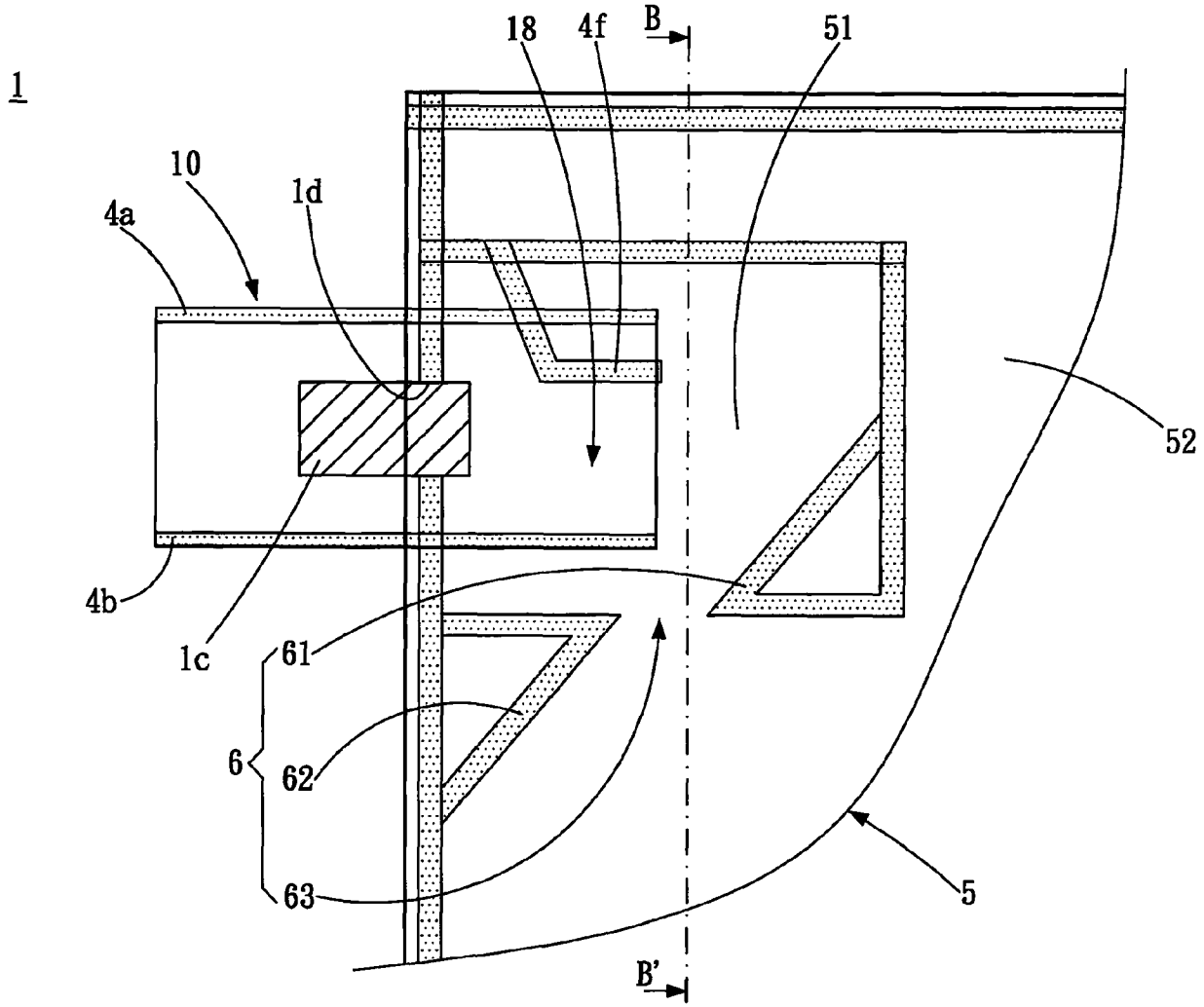
FIG. 5 is a second schematic front view according to the first embodiment of the present invention.

The warp portion 6 may be formed of the two outer films 2*a* and 2*b* through heat-seal bonding, and is located between the buffer portion 51 and the gas storage portion 52. In addition, the warp portion 6 has heat seal portions 61 and 62, and more than one connecting hole 63 is disposed between the heat seal portions 61 and 62 so the buffer portion 51 and the gas storage portion 52 are in communication. A side of the warp portion 6 is the buffer portion 51, and the gas stop valve 10 located inside the buffer portion 51 may be preferably disposed corresponding to the connecting hole 63, so that the gas tube 9 may pass through the gas stop valve 10 and then pass through the connecting hole 63, so as to directly inflate and deflate the gas storage portion 52. Here, the heat seal portion 61 may have a straight or curved heat seal line structure. The heat seal portion 62 may be a polygon heat seal block or a polygon block formed of the straight or curved heat seal lines being connected. The two outer films 2*a* and 2*b* are incapable of inflation and expansion at the heat seal portions 61 and 62 formed by means of heat sealing, so that a bending effect is produced at the heat seal portions 61 and 62 after the inflation and expansion of the gas chamber area 5. The above manner of disposing the gas stop valve 10 corresponding to the connecting hole 63 and the structures of the heat seal portions 61 and 62 are merely exemplary, and the present invention is not limited thereto. For example, the heat seal portion 61 may be a straight or curved heat seal line and connected to a polygon block (as shown in FIG. 3 and FIG. 5). A part of the heat seal portions 61 and 62 should be in the same straight line, so that the connecting hole 63 between the heat seal portions 61 and 62 is formed on the straight line.

Figure 4A:
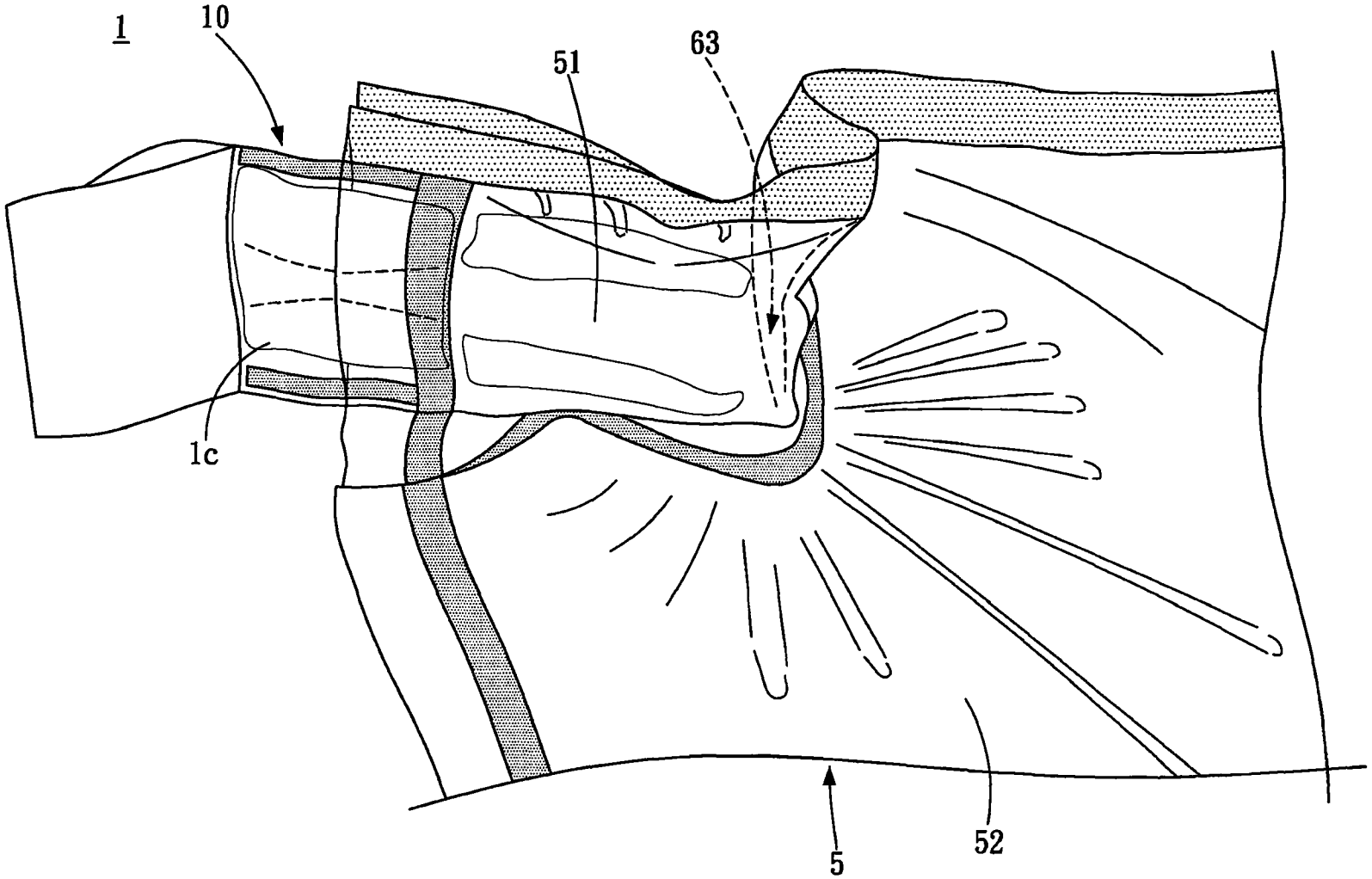
FIG. 4A is a first schematic external view of warp according to the first embodiment of the present invention.
Figure 4B:
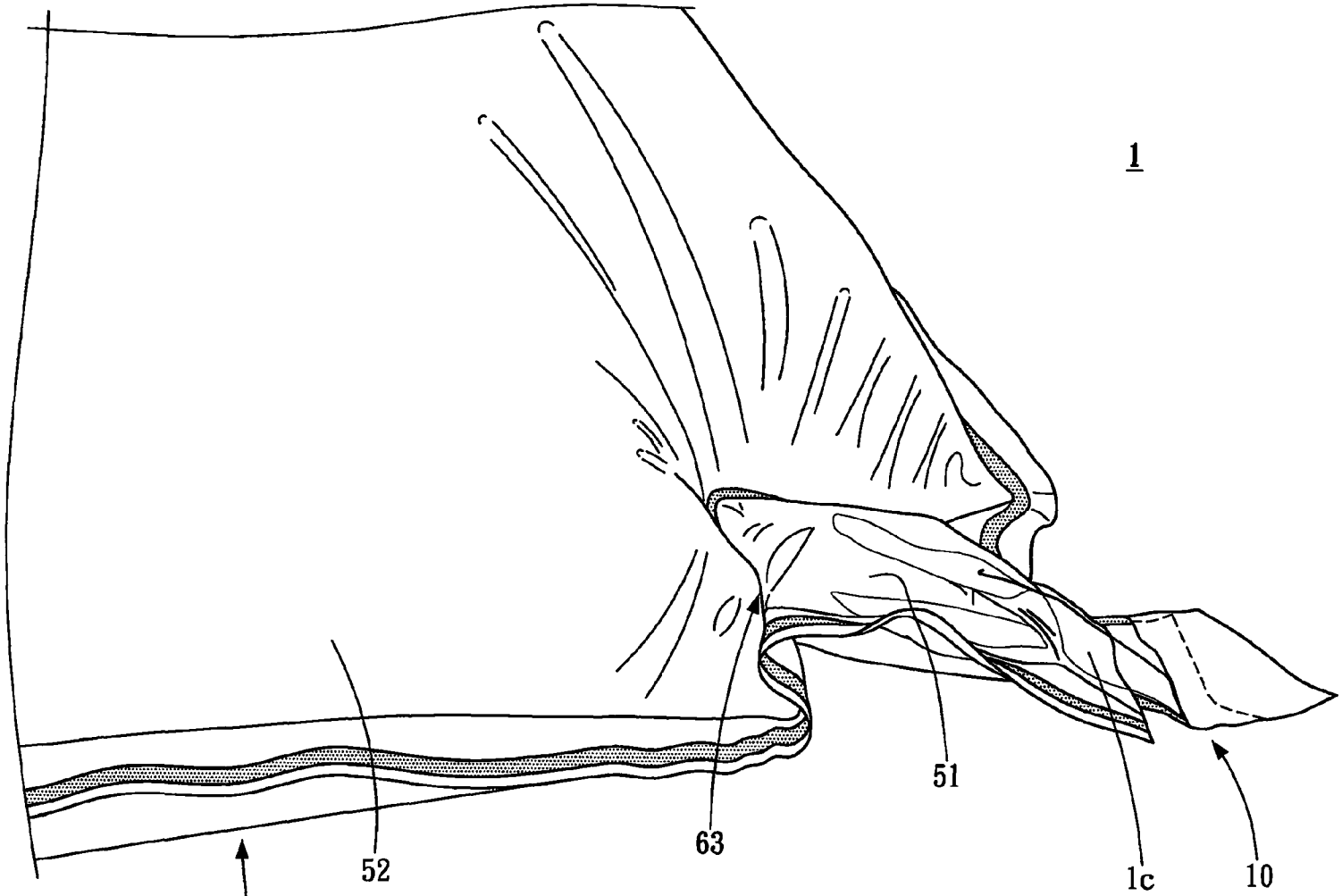
FIG. 4B is a second schematic external view of warp according to the first embodiment of the present invention.
Figure 6:
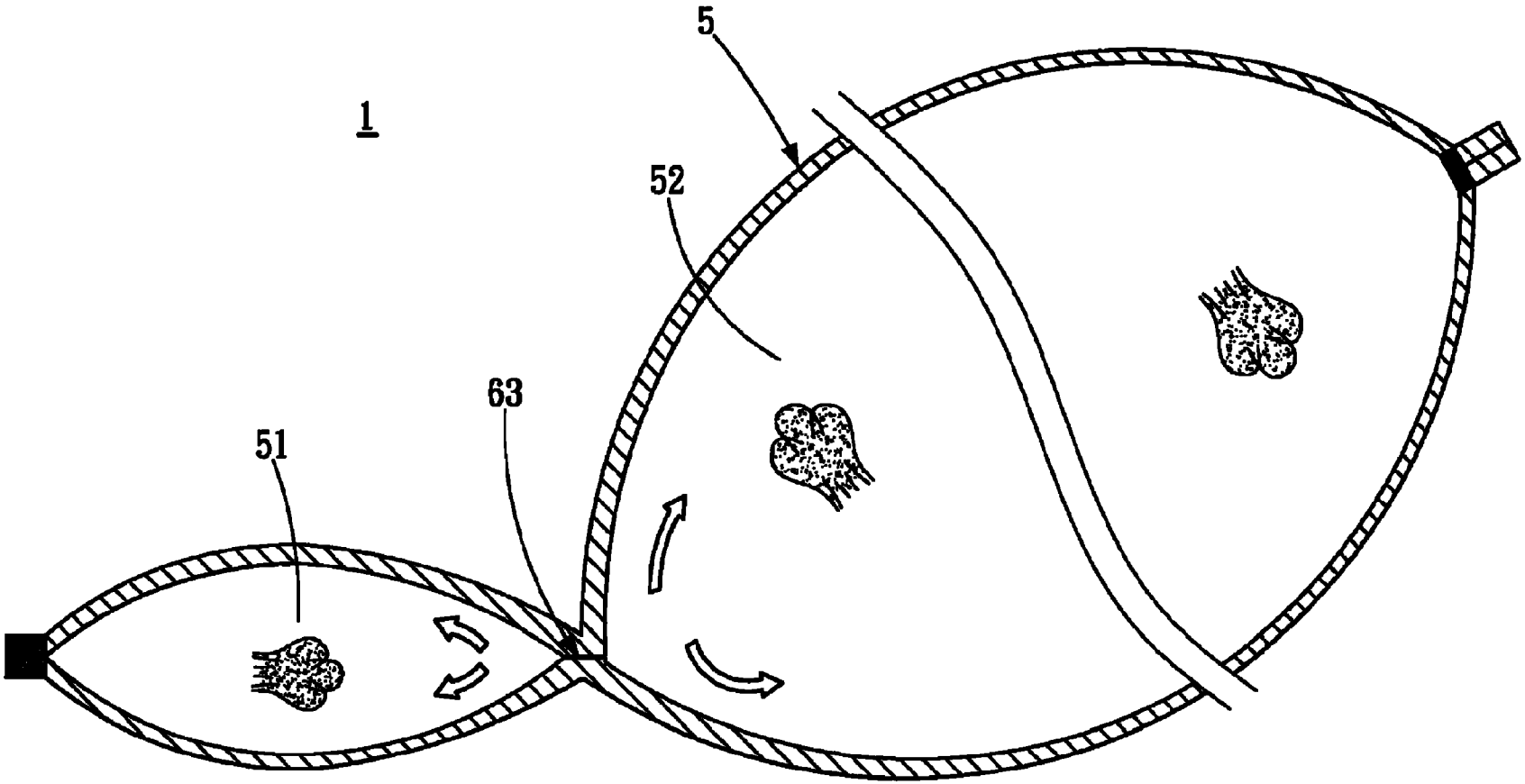
FIG. 6 is a schematic sectional view along b-b' in FIG. 5.

During inflation, the gas enters the buffer portion 51 from between the two second inner films 11*b* of the gas stop valve 10, and inflates the gas storage portion 52 through the connecting hole 63. As the area of the buffer portion 51 is smaller than the area of the gas storage portion 52, a pressure inside the buffer portion 51 is smaller. As a pressure inside the gas storage portion 52 gradually increases, the gas storage portion 52 bends towards the buffer portion 51 with the warp portion 6 as a central point, so that the two outer films 2*a* and 2*b* at the connecting hole 63 bend to seal the connecting hole 63 to prevent the gas in the gas storage portion 52 from escaping (as shown in FIG. 4A, FIG. 4B and FIG. 6), thereby effectively preventing gas leakage of the gas storage portion 52 to achieve a first gas closure effect. The gas inside the buffer portion 51 presses the two second inner films 11*b* of the gas stop valve 10 together, thereby preventing the gas from flowing back through the gas stop valve 10 to escape, so as to achieve a second gas closure effect. Therefore, the present invention can achieve a double gas closure effect through the warp portion 6 and the gas stop valve 10.

During deflation, the gas tube 9 may pass through the guiding passage 18 on the gas stop valve 10 to be inserted into the gas storage portion 52. One end of the gas stop valve 10 is located inside the buffer portion 51. As a size of the buffer portion 51 is small, especially when the warp portion 6 shrinks to make the gas storage portion 52 bend, the pressure inside the buffer portion 51 is smaller compared with the gas storage portion 52. Therefore, the resistance for the gas tube 9 to be inserted along the guiding passage 18 is small and the insertion becomes easy. In a conventional structure, the removal of the gas tube breaks the gas stop valve or damages the gas stop valve by dragging out the gas stop valve at the same time. Therefore, in the present invention, the gas stop valve 10 is firmly located between the two outer films 2*a* and 2*b* through bonding of the heat seal line 4*f*, thereby effectively solving the problems that the removal of the gas tube 9 breaks the inner films 1*a* and 1*b* of the gas stop valve 10 or drags the gas stop valve 10 out of the guiding passage 18.

Figure 7:
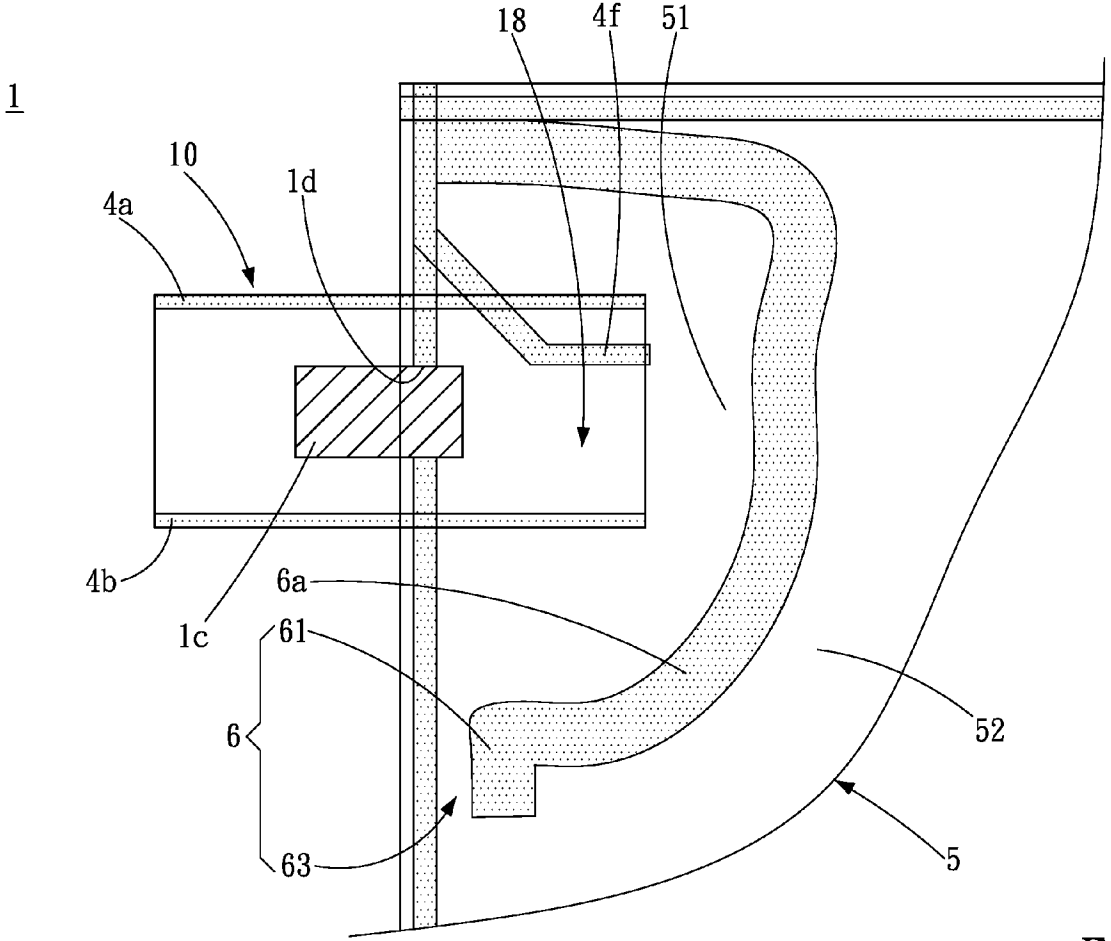
FIG. 7 is a first schematic front view according to a second embodiment of the present invention.
Figure 8:
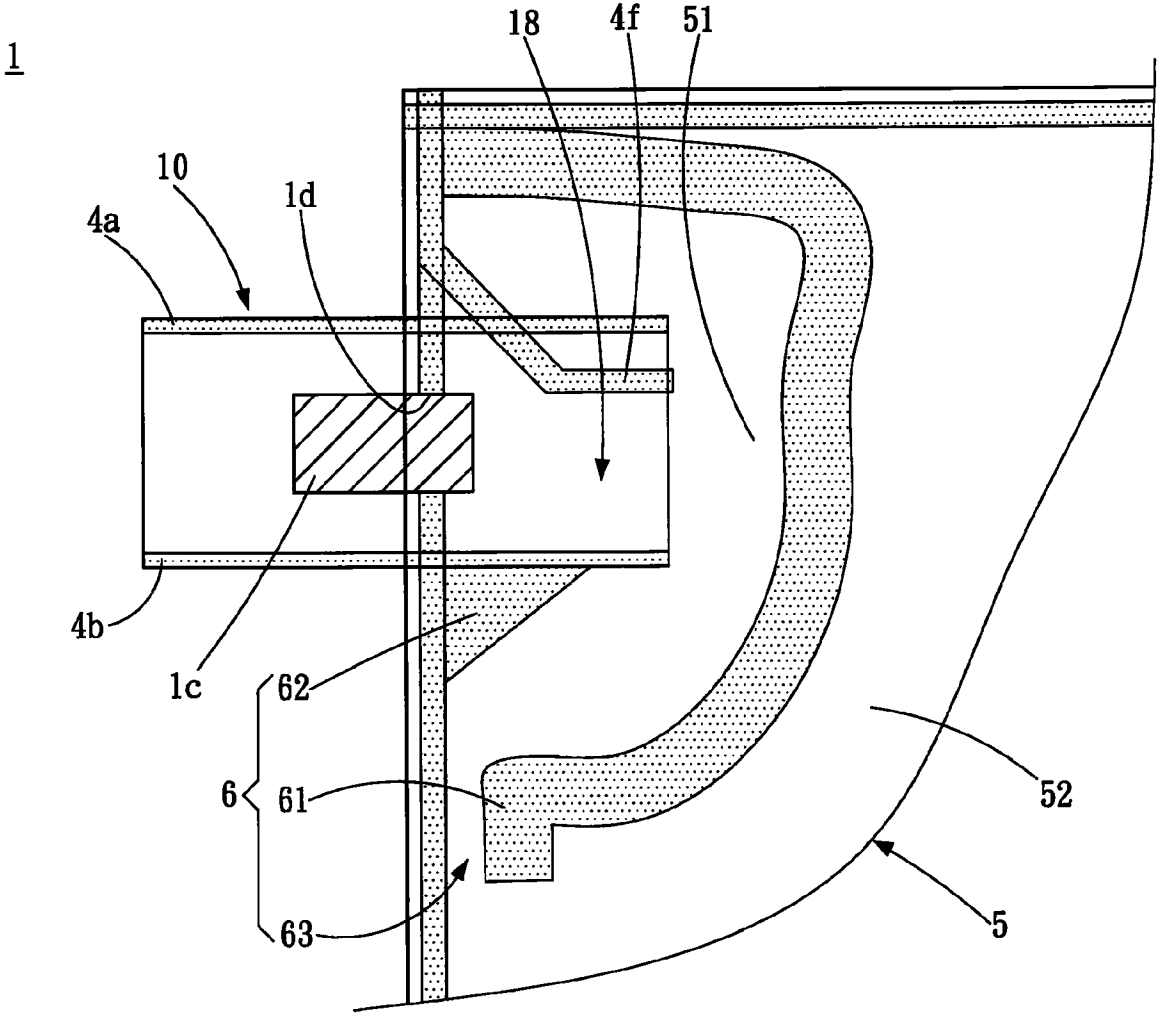
FIG. 8 is a second schematic front view according to the second embodiment of the present invention.

FIG. 7 shows a gas stop structure capable of repeated inflation and deflation according to a second embodiment of the present invention. A biggest difference between this embodiment and the first embodiment lies in a structure of the warp portion 6. In this embodiment, a heat seal portion 61 of the warp portion 6 is a curved heat seal line, and the warp portion 6 has a bending side 6*a* adjacent to a buffer portion 51. A connecting hole 63 is formed between a heat seal line 3*a* and the heat seal portion 61, so that the gas can only reach the connecting hole 63 through the bending side 6*a*, so as to enhance a gas closure effect. In addition, a polygonal heat seal portion 62 may be disposed at a gas stop valve 10 to form a flat buffer slope (as shown in FIG. 8), so that an inflated and expanded gas storage portion 52 naturally bends at the connecting hole 63 to achieve the gas closure effect.

Figure 9:
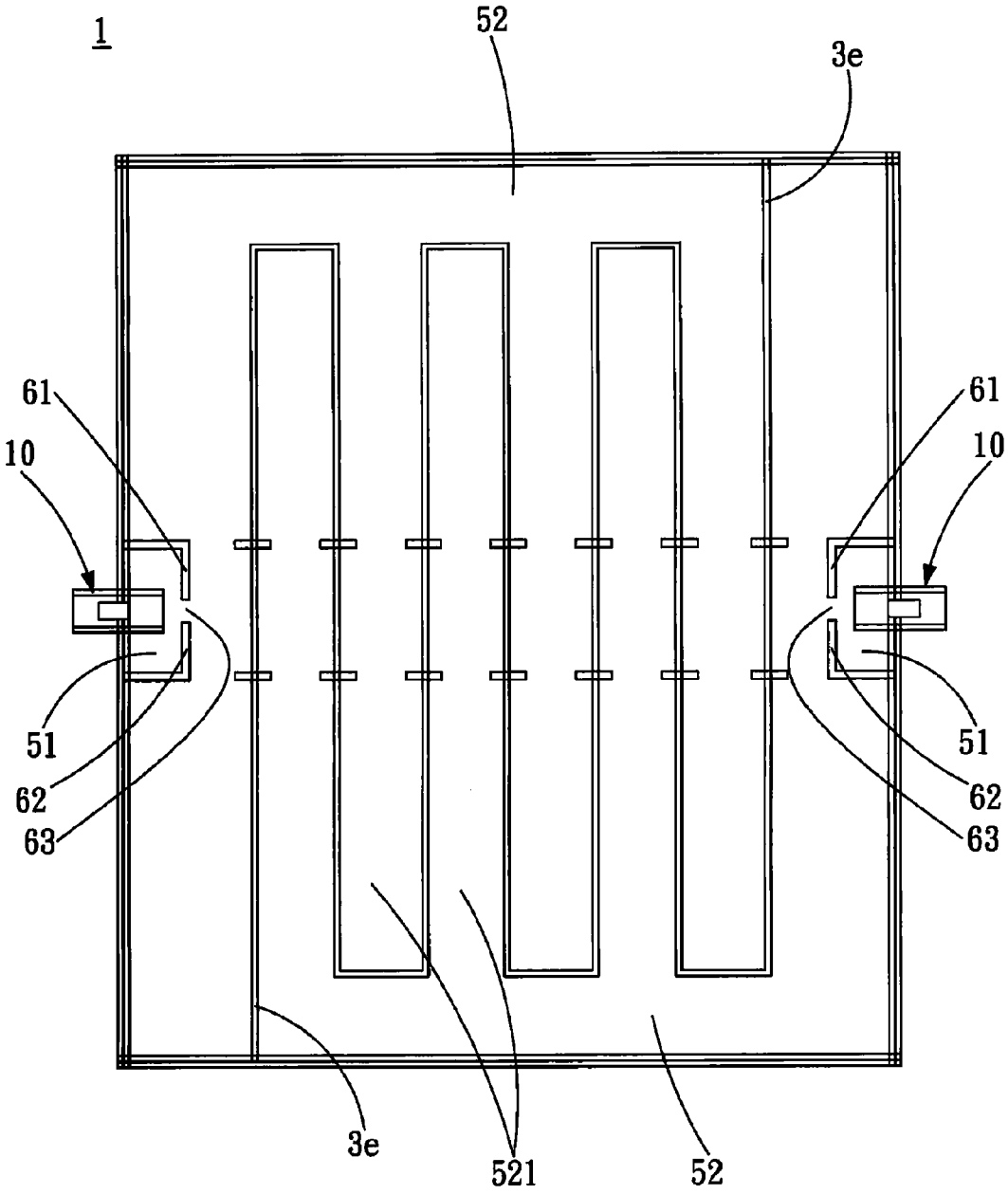
FIG. 9 is a schematic front view according to a third embodiment of the present invention.

FIG. 9 shows a gas stop structure capable of repeated inflation and deflation according to a third embodiment of the present invention. A biggest difference between this embodiment and the previous embodiments lies in a structure of the gas storage portion 52. In this embodiment, the gas storage portion 52 is divided into two independent gas columns 521 by a heat seal line 3*e*, and each gas column 521 is used in coordination with the buffer portion 51, the warp portion 6 and the gas stop valve 10 in the previous embodiments, which is no longer described. In this manner, when either gas column 521 is damaged, the other gas column 521 may still achieve a buffer protection effect.

Figure 10:
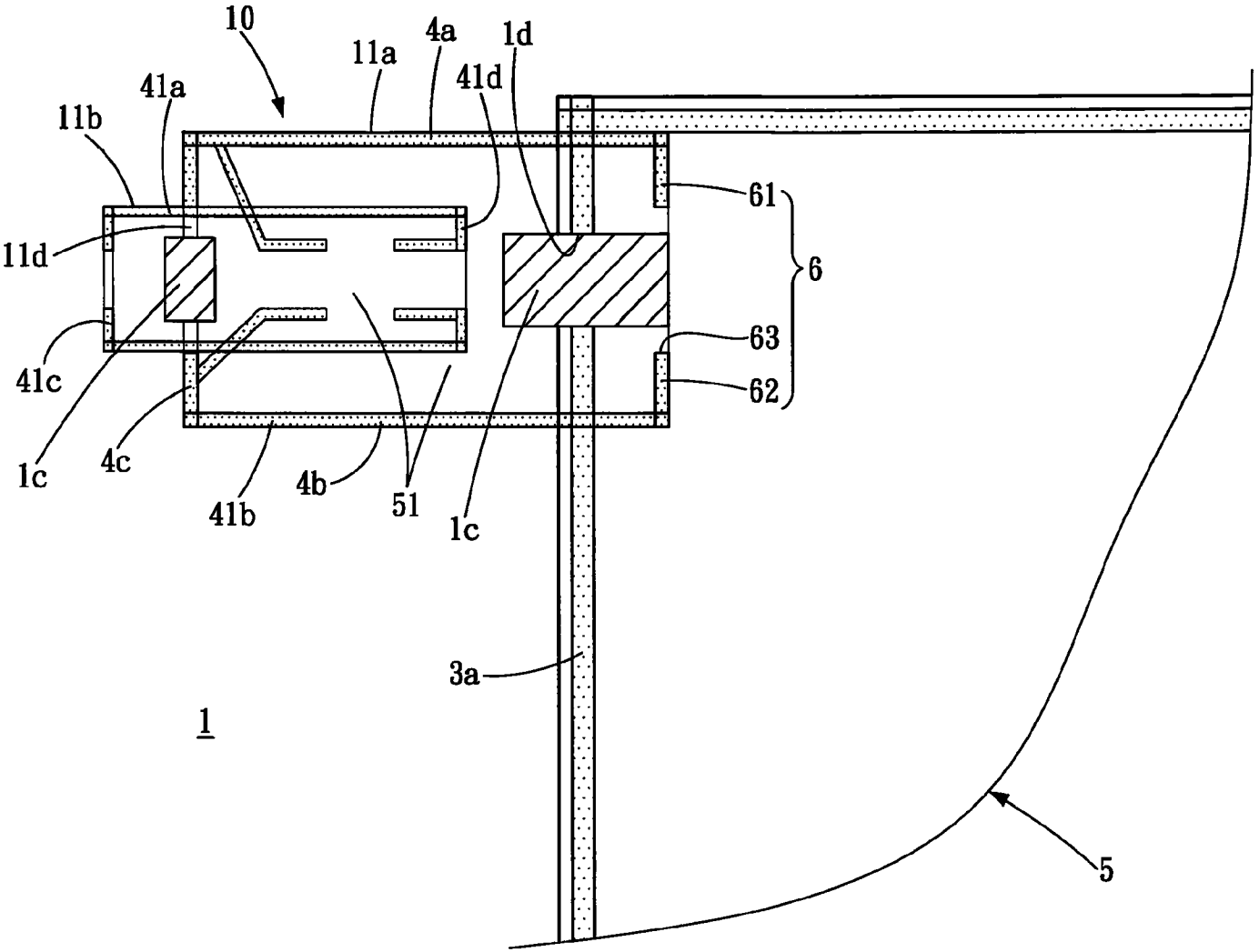
FIG. 10 is a schematic front view according to a fourth embodiment of the present invention.
Figure 11:
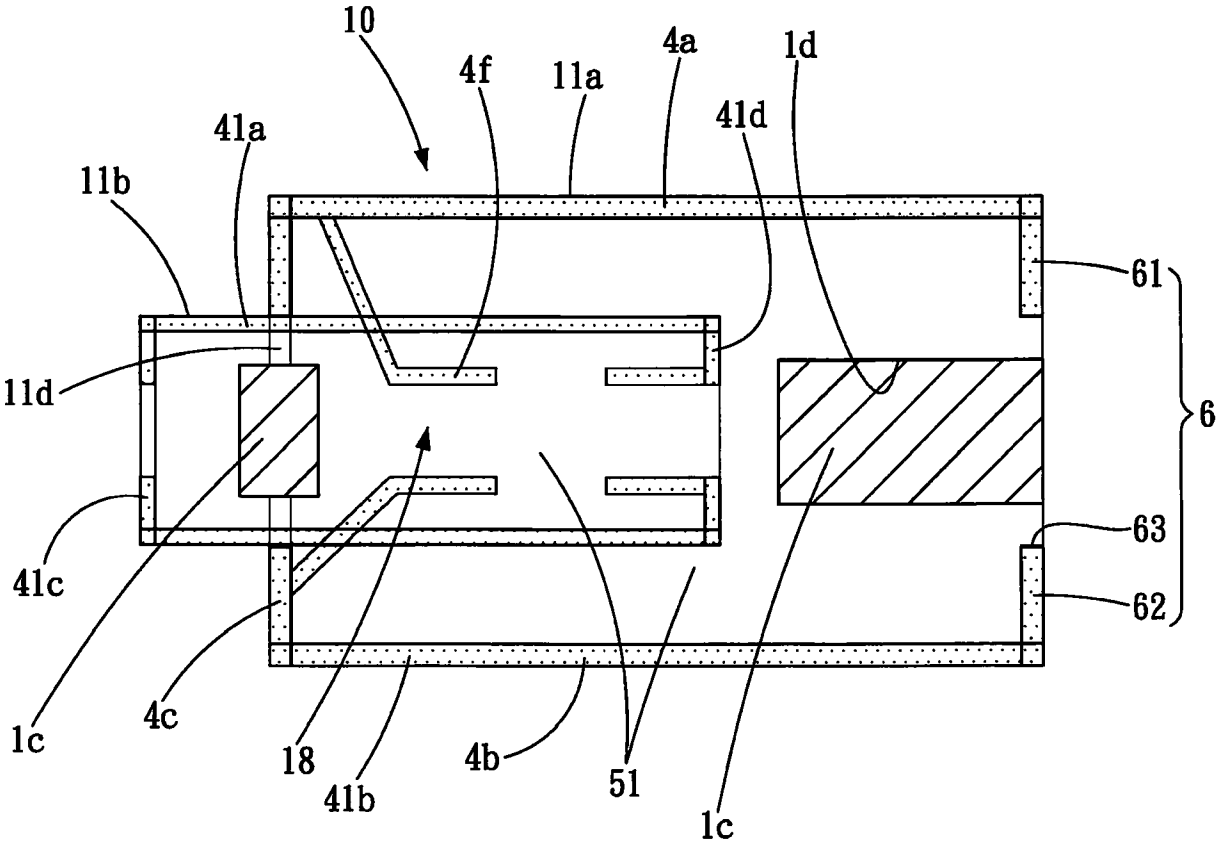
FIG. 11 is a local enlarged view according to the fourth embodiment of the present invention.

FIG. 10 and FIG. 11 show a gas stop structure capable of repeated inflation and deflation according to a fourth embodiment of the present invention. The biggest difference between this embodiment and the previous embodiments lies in the structures of the gas stop valve 10 and the buffer portion 51. In this embodiment, the gas stop valve 10 includes a plurality of first inner films 11*a* and a plurality of second inner films 11*b*. The plurality of first inner films 11*a* is stacked and a part thereof is exposed beyond the two outer films 2*a* and 2*b*. The plurality of second inner films 11*b* is stacked and is located between the plurality of first inner films, and a part of a plurality of the second inner films 11*b* is exposed beyond the plurality of first inner films 11*a*. The plurality of first inner films 11*a* may be bonded through heat seal lines 4*a*, 4*b* and 4*c* formed by means of heat sealing. A heat-resistant material 1*c* is provided between the plurality of first inner films 11*a*. When the heat seal line 3*a* is bonded to the plurality of first inner films 11*a* and the two outer films 2*a* and 2*b*, the plurality of first inner films 11*a* is not bonded at the heat-resistant material 1*c* to form an opening 1*d* for the gas to flow. The plurality of second inner films 11*b* may be bonded through heat seal lines 41*a*, 41*b*, 41*c*, and 41*d* formed by means of heat sealing. Furthermore, according to a practical structure design, the heat-resistant material 1*c* may be disposed between the plurality of second inner films 11*b* to form an opening 11*d*. In this embodiment, a buffer portion 51 is located between the plurality of first inner films 11*a*, in which a part of the buffer portion 51 is located at an area where the plurality of first inner films 11*a* and the two outer films 2*a* and 2*b* are stacked, and an area of the buffer portion 51 is smaller than an area of a gas storage portion 52.

In addition, the plurality of second inner films 11*b* is bonded by means of heat sealing to form a heat seal line 4*f* (or at the same time the plurality of first inner films 11*a* and the plurality of second inner films 11*b* are bonded). A guiding passage 18 may be formed at a side of the heat seal line 4*f* to guide a gas tube 9 to be placed into or removed from the gas stop valve 10. In addition, a warp portion 6 may be formed of the two outer films 2*a* and 2*b* and two first inner films 11*a* through heat-seal bonding, and located between the buffer portion 51 and the gas storage portion 52.

Figure 12A:
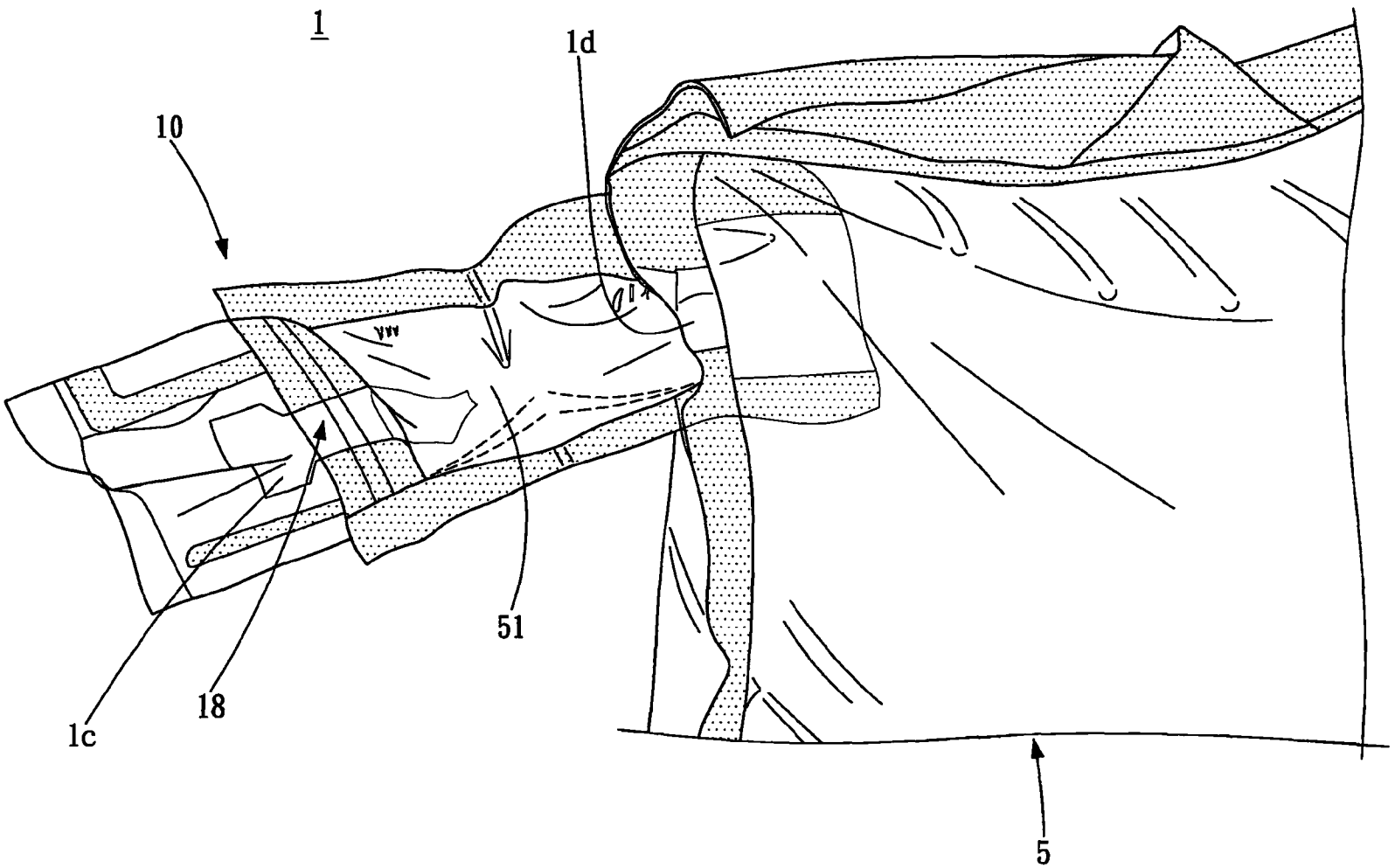
FIG. 12A is a first schematic external view of warp according to the fourth embodiment of the present invention.
Figure 12B:
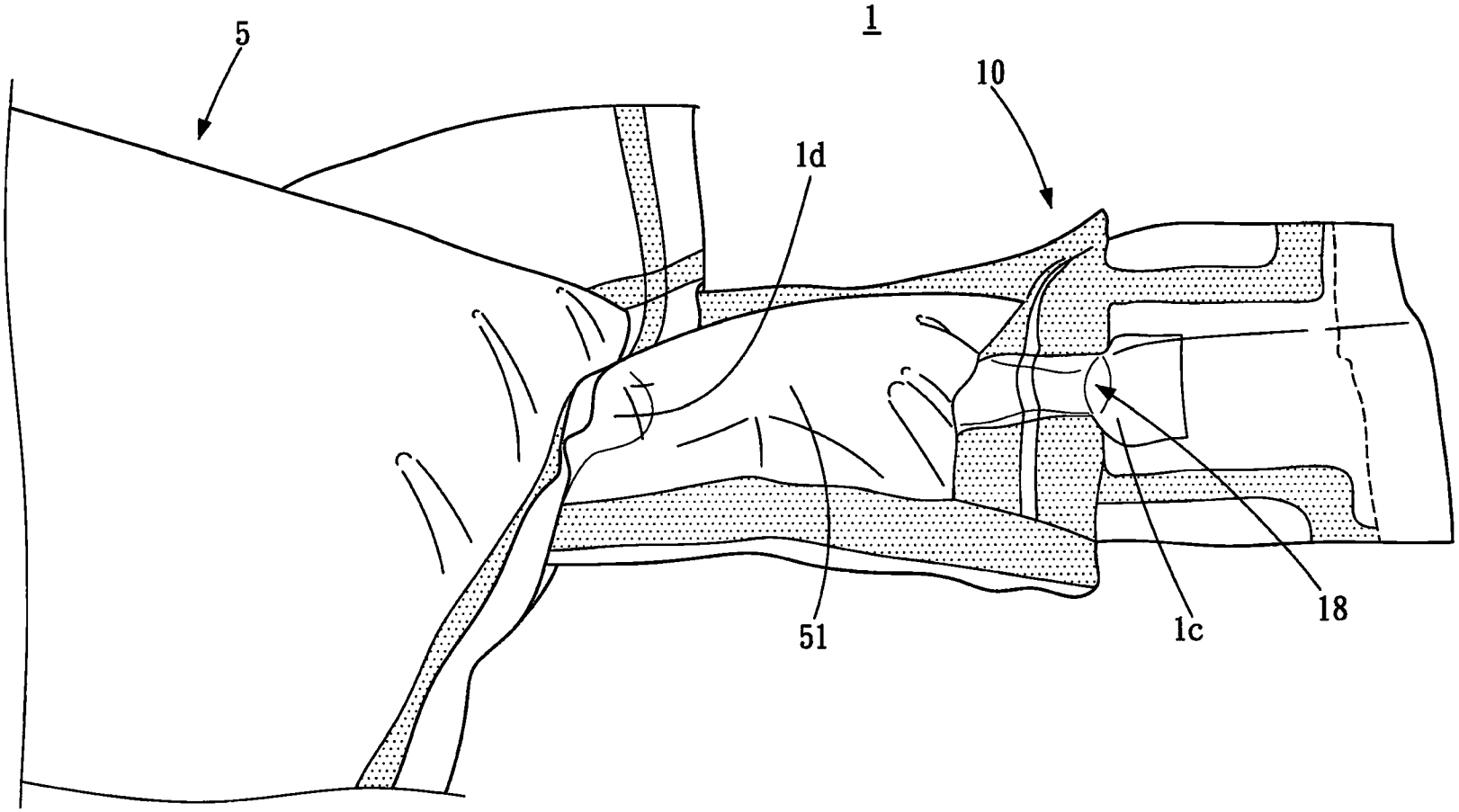
FIG. 12B is a second schematic external view of warp according to the fourth embodiment of the present invention.

The inflation is implemented from the opening 11*d* with the gas tube 9. Alternatively, the gas tube 9 may pass through the opening 1*d* or a connecting hole 63 to directly inflate the gas storage portion 52. The deflation may be implemented in the similar manner. After the inflation, the gas tube 9 is removed. The gas inside the gas storage portion 52 presses the two first inner films 11*a*, so that the two inner films 11*a* are adhered to seal the connecting hole 63. The gas in the gas tube 9 flows into the buffer portion 51 along the connecting hole 63. The buffer portion 51 presses the gas stop valve 10 after expansion with the gas, so that the gas cannot flow back through the gas stop valve 10 to form gas closure. In this manner, an automatic gas stop objective is achieved, and at the same time a double gas closure effect is achieved (as shown in FIG. 12 and FIG. 12*a*). Further, as an area of the buffer portion 51 is small, an internal gas pressure in the buffer portion 51 is low. When the gas must be discharged, the gas tube 9 is inserted along the opening 11*d* and reaches the connecting hole 63 through the opening 1*d* for successful deflation. During deflation, when the gas tube 9 is removed, the plurality of second inner films 11*b* is located through the heat seal line 4*f*. Consequently, the gas stop valve 10 is not broken during removal, and the gas tube 9 can be removed readily.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A gas stop structure capable of repeated inflation and deflation, comprising:

a plurality of outer films;

a gas chamber area, formed of the outer films through heat-seal bonding and comprising a buffer portion and a gas storage portion, wherein an area of the buffer portion is smaller than an area of the gas storage portion;

a gas stop valve, located between the outer films through heat-seal bonding, wherein a part of the gas stop valve is located inside the buffer portion, and another part of the gas stop valve is exposed beyond the outer films; and a warp portion, formed of the outer films through heat-seal bonding and located between the buffer portion and the gas storage portion, wherein the warp portion comprises a connecting hole through which the buffer portion and the gas storage portion are in communication; when the gas chamber area is inflated with gas through the gas stop valve, a height of the inflated gas storage portion is greater than that of the buffer portion to form a sectional difference, so that the gas storage portion bends towards the buffer portion with the warp portion as a central point to seal the connecting hole; the gas in the buffer portion presses the gas stop valve to close the gas stop valve to achieve a double gas closure effect.

2. The gas stop structure capable of repeated inflation and deflation according to claim 1, wherein the gas stop valve has a heat-resistant material, a gas inlet is formed through heat-seal bonding, a gas tube pass through the gas inlet to be placed in the buffer portion or the gas storage portion; the gas stop valve is formed of a plurality of first inner films through heat-seal bonding.

3. The gas stop structure capable of repeated inflation and deflation according to claim 2, wherein the gas stop valve further comprises a plurality of second inner films located between the first inner films.

4. The gas stop structure capable of repeated inflation and deflation according to claim 3, wherein the second inner films are adhered to one of the first inner films, and the gas inlet is located between one of the second inner films and one of the first inner films.

5. The gas stop structure capable of repeated inflation and deflation according to claim 1, wherein the gas stop valve further comprises a guiding passage used for guiding a gas tube to be placed in or removed from the gas stop valve.

6. The gas stop structure capable of repeated inflation and deflation according to claim 1, wherein the warp portion comprises a bending side adjacent to the buffer portion.

7. A gas stop structure capable of repeated inflation and deflation, comprising:

a plurality of outer films;

a gas stop valve, located between the outer films through heat-seal bonding, wherein the gas stop valve comprises a plurality of first inner films, a plurality of second inner films and a buffer portion; a part of the first inner films is exposed beyond the outer films, the second inner films are located between the first inner films and partially exposed beyond the first inner films, the buffer portion is located between the first inner films; and an area of the buffer portion is smaller than an area of a gas storage portion; and a warp portion, formed of the outer films through heat-seal bonding and located between the buffer portion and the gas storage portion, wherein the warp portion comprises a connecting hole through which the buffer portion and the gas storage portion are in communication; when the gas storage portion is inflated with gas through the gas stop valve, gas in the gas storage portion presses the gas stop valve to seal the connecting hole, gas in the buffer portion presses the second inner films, so that the second inner films are adhered to achieve a double gas closure effect.

8. The gas stop structure capable of repeated inflation and deflation according to claim 7, wherein the second inner films are adhered to one of the first inner films.

9. The gas stop structure capable of repeated inflation and deflation according to claim 7, wherein the gas stop valve further comprises a guiding passage used for guiding a gas tube to be placed into or removed from the gas stop valve.

10. The gas stop structure capable of repeated inflation and deflation according to claim 7, wherein the warp portion comprises a bending side adjacent to the buffer portion.

* * * * *